US005653305A

United States Patent [19]

Duke

[11] Patent Number: 5,653,305

[45] Date of Patent: Aug. 5, 1997

[54] SELF-PROPELLED STEP LADDER

[76] Inventor: Judy A. Duke, R.R. 2 Box 56, Gillespie, Ill. 62033

[21] Appl. No.: 543,287

[22] Filed: Oct. 16, 1995

[51] Int. Cl.[6] ..... E04B 1/20

[52] U.S. Cl. ..... 182/13; 182/174

[58] Field of Search ..... 182/13–17, 165, 182/173–176

[56] References Cited

U.S. PATENT DOCUMENTS

| | | | |
|---|---|---|---|
| 918,553 | 4/1909 | Hoppe | 182/175 |
| 1,149,725 | 8/1915 | Burriss | 182/175 |
| 1,517,676 | 2/1924 | Haugh | 182/174 |
| 3,026,960 | 3/1962 | Koutnik | 182/15 |
| 3,865,203 | 2/1975 | Hibma | 182/16 |
| 4,967,733 | 11/1990 | Rousseau | 182/13 |

FOREIGN PATENT DOCUMENTS

| | | | |
|---|---|---|---|
| 1366222 | 6/1964 | France | 182/13 |

*Primary Examiner*—Alvin C. Chin-Shue

[57] ABSTRACT

A self-propelled stepladder including a moveable platform having a front end, a rear end, a front pair of wheels secured the front end, and a rear pair of wheels secured to the rear end; a motor having a rotor and a fixed stator coupled to the platform and with the stator imparting rotation to the rotor when electrically energized; a drive mechanism coupled to the platform for transferring rotational motion from the rotor to the wheels; a battery coupled to the platform for providing electrical energy to the motor; a switch mechanism coupled to the battery, the motor, and the driving mechanism for allowing the motor to be selectively energized and de-energized and for allowing the rotor of the motor to rotate and thereby impart forward or rearward motion to the platform via the drive mechanism; and a foldable step ladder having legs terminated at free ends; and a coupling mechanism for removably coupling the free ends of the step ladder to the platform in an extended and substantially vertical orientation for use.

1 Claim, 3 Drawing Sheets

SELF-PROPELLED STEP LADDER

BACKGROUND OF THE INVENTION

1. Field of the Invention

The present invention relates to a self-propelled step ladder and more particularly pertains to allowing a user to readily access an elevated location with a self-propelled step ladder.

2. Description of the Prior Art

The use of motorized ladder apparatuses is known in the prior art. More specifically, motorized ladder apparatuses heretofore devised and utilized for the purpose of allowing a user to access an elevated location are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 283,072 to Qureshi et al. discloses a self-propelled aerial work platform. U.S. Pat. No. 3,612,201 to Smith discloses a self-propelled platform tower. U.S. Pat. No. 3,735,838 to Greenleaf discloses a wheeled ladder with a weight actuated self-locking wheel thereon. U.S. Pat. No. 4,457,403 to Ream discloses a self-propelled elevating work platform. U.S. Pat. No. 4,512,440 to Bixby discloses a rungless motorized ladder. U.S. Pat. No. 5,082,086 to Kerr discloses a wheeled ladder.

While these devices fulfill their respective, particular objective and requirements, the aforementioned patents do not describe a self-propelled step ladder that has varying forward speeds and a reverse speed to allow a step ladder to be readily positioned in its extended orientation for use.

In this respect, the self-propelled step ladder according to the present invention substantially departs from the conventional concepts and designs of the prior art, and in doing so provides an apparatus primarily developed for the purpose of allowing a user to readily access an elevated location.

Therefore, it can be appreciated that there exists a continuing need for new and improved self-propelled step ladder which can be used for allowing a user to readily access an elevated location. In this regard, the present invention substantially fulfills this need.

SUMMARY OF THE INVENTION

In the view of the foregoing disadvantages inherent in the known types of motorized ladder apparatuses now present in the prior art, the present invention provides an improved self-propelled step ladder. As such, the general purpose of the present invention, which will be described subsequently in greater detail, is to provide a new and improved self-propelled step ladder and method which has all the advantages of the prior art and none of the disadvantages.

To attain this, the present invention essentially comprises, in combination, a moveable platform. The platform has a front end, a rear end with an upwardly extended pedestal secured thereto, and a generally rectangular planar horizontal central section. The platform has a front axle coupled to the front end, a front wheel secured to each free end of the front axle, a rear axle coupled to the rear end of the platform, and a rear wheel secured to each free end of the rear axle. The platform has a forward pair of rigid bracing members coupled to and extended upwards from the front end and a rearward pair of rigid tubular bracing members coupled to and extended upwards from the pedestal. Lastly, the platform has a forward pair of spaced horizontal elongated rods secured to and extended outwards from the front end of the platform and a rearward pair of spaced elongated horizontal rods secured to and extended outwards from the rear end of the platform, and with each rod defining a handle that allows two oppositely positioned users a firm grip for lifting the platform.

A variable speed motor is included and has a rotatable rotor and a fixed stator. The stator is coupled to the central section of the platform. The stator of the motor imparts rotation to the rotor when electrically energized. An electronically-controlled gear box is included and coupled to the central portion of the platform. The gear box has an input rotor for receiving rotational motion, an output rotor for delivering rotational motion, and a plurality of meshed gears positioned therebetween for translating rotation of the input rotor to the output rotor.

A primary drive belt is provided and secured around the rotor of the motor and the input rotor of the gearbox. A secondary drive belt is also provided and secured around the output rotor of the gearbox and the rear axle. A battery is included and coupled to the central section of the platform for providing electrical energy to the motor. In addition, a switch mechanism is included and coupled to the battery, the motor, and the gearbox. The switch mechanism allows the motor to be selectively energized and de-energized and allows the rotor of the motor to rotate in one direction at one of two selectable speeds to thereby impart forward motion to the platform. Furthermore, the switch mechanism allows the rotor of the motor to rotate in another direction to thereby impart rearward motion to the platform.

A step ladder is also included and has planar rectangular top step with a forward extent and a rearward extent, a pair of spaced and tubular front legs pivotally coupled to the frontal extent of the top step and extending vertically downwards therefrom, and a pair of spaced and tubular back legs pivotally coupled to the rearward extent of the top shelf and extended angularly downwards therefrom. A sequence of spaced horizontal steps is coupled between the rear legs. A pair of braces is also included. Each brace has a forward end pivotally coupled to one of the front legs and a rearward end with a notch formed thereon that is removably securable to a pin affixed to the rearwardly positioned rear leg. Each leg of the ladder is terminated at an open and lower free end. The free ends of the front legs are removably secured within the forward pair of bracing members, and the free ends of the rear legs are removably secured within the rearward pair of bracing members to place the step ladder in an extended orientation for use. The legs are removable from the bracing members and foldable in a juxtaposed relation to thereby place the step ladder in a retracted orientation for storage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self-propelled step ladder which has all the advantages of the prior art motorized ladder apparatuses and none of the disadvantages.

It is another object of the present invention to provide a new and improved self-propelled step ladder which may be easily and efficiently manufactured and marketed.

It is a further object of the present invention to provide a new and improved self-propelled step ladder which is of durable and reliable construction.

An even further object of the present invention is to provide a new and improved self-propelled step ladder which is susceptible of a low cost of manufacture with regard to both materials and labor, and which accordingly is then susceptible of low prices of sale to the consuming public, thereby making such a self-propelled step ladder economically available to the buying public.

Still yet another object of the present invention is to provide a new and improved self-propelled step ladder which provides in the apparatuses and methods of the prior art some of the advantages thereof, while simultaneously overcoming some of the disadvantages normally associated therewith.

Even still another object of the present invention is to provide a new and improved self-propelled step ladder for allowing a user to readily access an elevated location.

Lastly, it is an object of the present invention to provide a new and improved self-propelled step ladder comprising a moveable platform having a front end, a rear end, a front pair of wheels rotatably secured the front end, and a rear pair of wheels rotatably secured to the rear end; a variable speed motor having a rotatable rotor and a fixed stator coupled to the platform, and with the stator imparting rotation to the rotor when electrically energized; an electronically controlled drive mechanism coupled to the platform for transferring rotational motion from the rotor to one of the pairs of wheels; a battery coupled to the platform for providing electrical energy to the motor; a switch mechanism coupled to the battery, the motor, and the driving mechanism for allowing the motor to be selectively energized and de-energized, for allowing the rotor of the motor to rotate in at a selectable speed to thereby impart forward motion to the platform, and for allowing the rotor of the motor to rotate in another direction to thereby impart rearward motion to the platform; and a foldable step ladder having legs terminated at free ends; and a coupling mechanism for removably coupling the free ends of the step ladder to the platform in an extended and substantially vertical orientation for use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
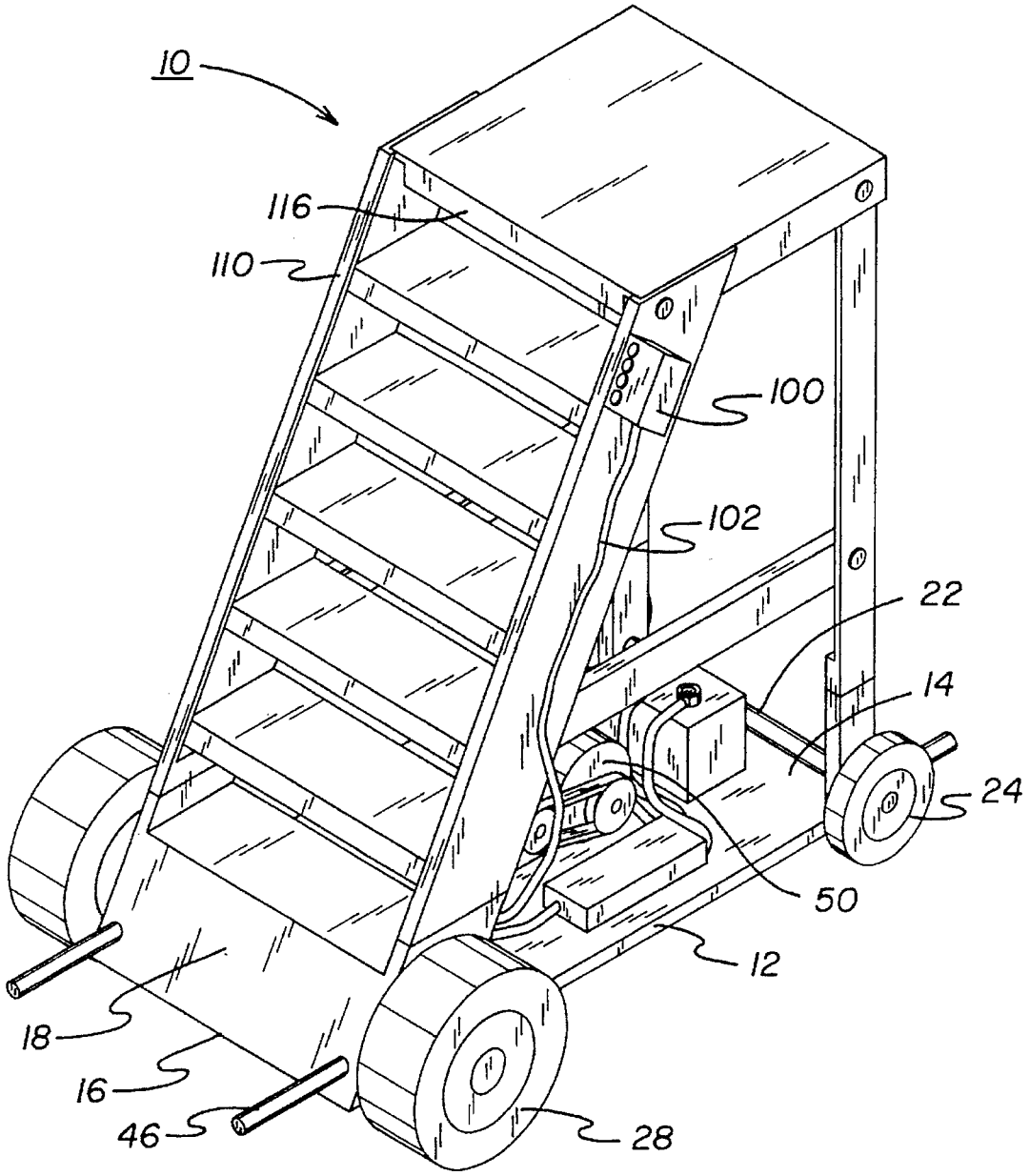
FIG. 1 is a perspective view of the preferred embodiment constructed in accordance with the principles of the present invention.
Figure 3:
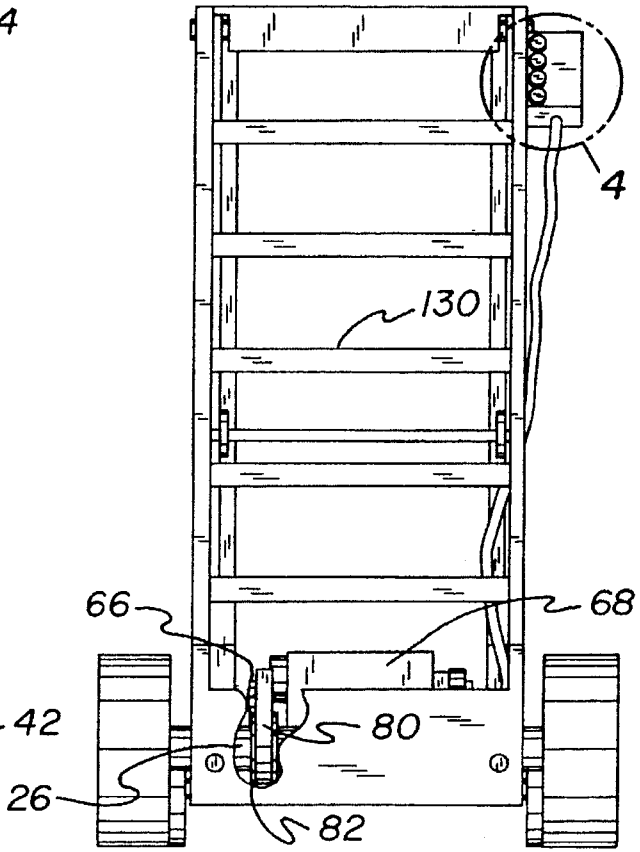
FIG. 3 is a rear-elevational view of the preferred embodiment of the present invention.

With reference now to the drawings, and in particular, to FIG. 1 thereof, the preferred embodiment of the new and improved self-propelled step ladder embodying the principles and concepts of the present invention and generally designated by the reference number 10 will be described.

The preferred embodiment of the present invention comprises a plurality of components. In their broadest context, such components include a movable platform, a drive mechanism for moving the platform, and a step ladder. Such components are individually configured and correlated with respect to each other to provide the intended function.

Specifically, the present invention includes a movable metal or plastic platform 12 as shown in FIG. 1. The platform has a front end 14, a rear end 16 with an upwardly extended rigid pedestal secured thereto, and a generally rectangular planar horizontal central section 20. A front axle 22 is coupled to the front end 14 of the platform and terminated at free ends. A front wheel 24 is secured to each end of the front axle. Likewise, a rear axle 26 is coupled to the rear end 16 of the platform and terminated at free ends. A rear wheel 28 having a larger diameter than a front wheel is secured to each free end of the rear axle. Each wheel includes a hub 30 with a rubber tire 32 secured to the hub. Each rear wheel has a larger axial length than the front wheels. The larger wheels on the back of the present invention bear a majority of weight placed upon the pedestal. The platform also includes a forward pair of rigid and upwardly extending bracing members 34. The forward pair of bracing members is coupled to and extended upwards from the front end. Also, a rearward pair 36 of rigid upwardly extending bracing members are coupled to and extended upwards from the pedestal 18. Each bracing member has an upper tapered portion 38 that defines a tenon 39 bounded by an abutment edge 40. Lastly, the platform includes a forward pair of spaced horizontal elongated rods 42 secured to and extended outwards from the front end 14 of the platform, and a rearward pair of spaced elongated horizontal rods 44 secured to and extended outwards from the rear end of the platform. The rods of the pairs are aligned about parallel and equidistant axes. Each rod defines a handle 46 that allows two oppositely positioned users a firm grip for lifting the platform.

The present invention also includes a variable speed motor 50. The motor has a rotatable rotor 52 and a fixed stator 54. The stator is coupled to the central section 20 of the platform. The stator imparts rotation to the rotor when it is electrically energized. An electronically-controllable gear box 60 is coupled to the central portion 20 of the platform. The gear box has an input rotor 62 for receiving rotational motion, an output rotor 66 for delivering rotational motion, and a plurality of unillustrated meshed gears positioned therebetween and encased in housing 68. The meshed gears translate rotation of the input rotor to the output rotor.

A primary drive belt 70 is secured around the rotor 56 of the motor and the input rotor 62 of the gearbox. The drive belt 70 translates rotational motion of the rotor to the input rotor of the gearbox. In addition, a secondary drive belt 80 is secured around the output rotor 66 of the gearbox and a sprocket 82 on the rear axle. The drive belt transfers rotational motion of the output rotor 66 to the sprocket 82.

A battery 90 is coupled to the central section 20 of the platform. The battery is used for providing electrical energy to the motor through a pair of battery cables 92. Preferably, a conventional 12-volt automotive battery is used.

The present invention also includes a remotely positionable switch mechanism 100. The switch mechanism is coupled to the battery 90, the motor 50, and the gearbox 60 with a long and sheathed electric cable 102. The switch mechanism allows the motor to be selectively energized and de-energized through manual actuation of button 103. The switch mechanism also allows the rotor 56 of the motor to rotate in one direction and at one of two selectable speeds to impart forward motion to the platform. A fast forward speed is selected through manual actuation of button 104. A slow forward speed is selected through manual actuation of button 105. Lastly, the switch mechanism allows the rotor of the motor to rotate in another direction to thereby impart rearward motion to the platform. Reverse motion is attained through manual actuation of button 106. The switch mechanism is encased in rigid rectangular box-shaped housing 107 having an inboard groove 108 formed on one of its sides.

A step ladder 110 is also provided. The step ladder is formed of a rigid material such as wood, metal, or plastic. The step ladder includes a planar rectangular top step 112 with a forward extent 114 and a rearward extent 116. A pair of tubular and spaced front legs 120 are pivotally coupled to the forward extent 114 of the top step with fasteners 122. The front legs extend vertically downwards from the top step. In addition, a pair of tubular and spaced back legs 124 are pivotally coupled to the rearward extent 116 of the top step. The back legs are extended angularly downwards from the top step. The ladder also includes a sequence of spaced and horizontal steps 130 that are coupled between the rear legs. The steps are of a size to accommodate a user's feet.

Figures 4, 5, 6:
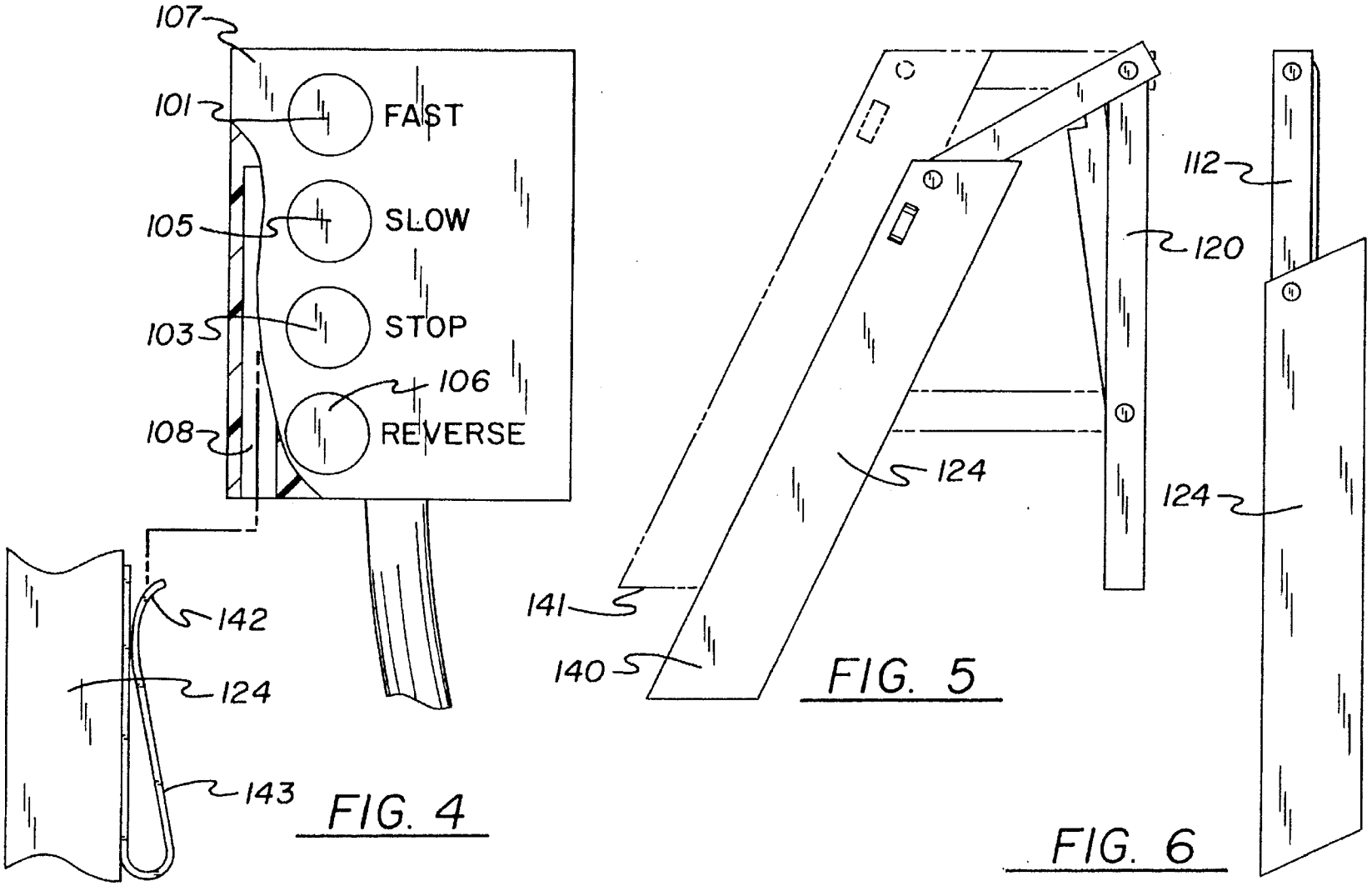
FIG. 4 is a view of the switch mechanism of the present invention as previously shown in detail 4 of FIG. 3.
FIG. 5 is a side-elevational view of the ladder being placed in its folded configuration.
FIG. 6 is a view of the ladder in its final position for stowage.

The step ladder also has a pair of supporting braces 132. Each brace has a forward end 134 pivotally coupled to one of the front legs with a fastener 122 and a rearward end with a downwardly facing notch 136 formed thereon. The notch is removably securable to a pin 138 that is affixed to the rearwardly positioned rear leg. Each leg of the ladder is terminated at a lower open free end 140 that defines a mortise 141. The mortises on the free ends of the front legs 120 are removably secured with the tenons 39 of the forward pair of bracing members and in contact with the associated abutment edges. The mortises on the free ends of the rear legs 124 are likewise removably secured with the tenons of the rearward pair of bracing members and in contact with the associated abutment edges. When the rear legs and front legs have the tenons of the applicable bracing member secured within, the step ladder is placed in an extended orientation for use as shown in FIG. 1. The legs are removable from the bracing members and foldable in a juxtaposed relation to thereby place the step ladder in a retracted orientation for storage as shown in FIG. 6.

Figure 2:
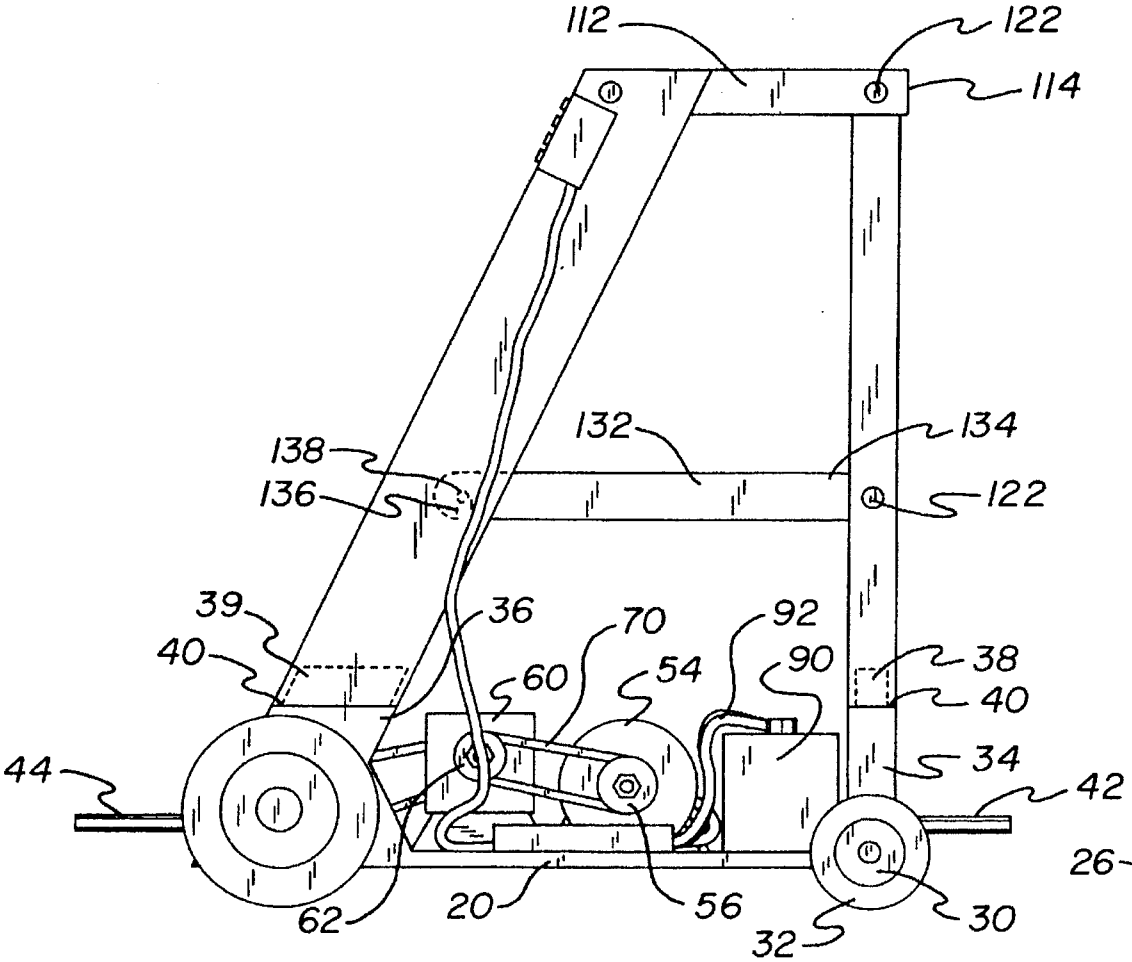
FIG. 2 is a side-elevational view of the preferred embodiment of the present invention.

The step ladder also includes a spring-like clip 140 secured to one of the front legs 120. The clip has a free end 142 that is securable within the groove 108 on the housing 107. When the clip is secured within the groove, the switch mechanism is placed at an elevated location on the ladder as shown in FIG. 2. Thus, a user can adjust the position of the platform when standing on the ladder through actuation of the switch mechanism. The switch mechanism is removable from the clip and the electrical cable 102 is extendable for allowing a user to stand away from the platform and then reposition it.

The present invention is a motorized step ladder that is designed to save a user time and effort during construction projects such as remodeling, painting, washing walls, or the like. The present invention includes a motorized and wheeled platform to which a step ladder is mounted. Power is provided to the drive assembly by a standard 12-volt rechargeable battery. The drive or rear wheels are about 10 inches in diameter and about 6 inches wide. The front wheels are about 2½ inches in diameter and about 1 inch wide.

The drive control switch can be placed in the holding bracket located near the top step of the ladder, within convenient reach of the user. The drive control switch can also be removed from the holding bracket for operation from the ground. Two forward speeds and reverse are available. A stop control activates the braking system which is designed as part of the motor and gearbox assembly. The step ladder component can be removed from the platform and folded for convenient transport or storage. The motorized platform is provided with handles for lifting it into a truck or a van cargo area. Step ladders of differing heights can be made to install on the platform as appropriate.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A self-propelled stepladder comprising, in combination:

a moveable platform having a front end, a rear end with an upwardly extended pedestal secured thereto, a generally rectangular planar horizontal central section, a front axle coupled to the front end and terminated at free ends, a front wheel secured to each free end of the front axle, a rear axle coupled to the rear end of the platform and terminated at free ends, a rear wheel secured to each free end of the rear axle, a forward pair of rigid bracing members coupled to and extended upwards from the front end, a rearward pair of rigid tubular bracing members coupled to and extended upwards from the pedestal and at an acute angle with respect to the planar horizontal central section, each bracing member having an upper tapered portion defining a tenon bounded by an abutment edge, a forward pair of spaced horizontal elongated rods secured to and extended outwards from the front end of the platform, and a rearward pair of spaced elongated horizontal rods secured to and extended outwards from the rear end of the platform and with each rod defining a handle that allows two oppositely positioned users a firm grip for lifting the platform;

a variable speed motor having a fixed stator coupled to the central section of the platform and a rotatable rotor, and with the stator imparting rotation to the rotor when electrically energized;

an electronically-controlled gear box coupled to the central portion of the platform, the gear box having an input rotor for receiving rotational motion, an output rotor for delivering rotational motion, and a plurality of meshed gears positioned therebetween for translating rotation of the input rotor to the output rotor;

a primary drive belt secured around the rotor of the motor and the input rotor of the gearbox;

a secondary drive belt secured around the output rotor of the gearbox and the rear axle;

a battery coupled to the central section of the platform for providing electrical energy to the motor;

switch means coupled to the battery, the motor, and the gearbox for allowing the motor to be selectively energized and de-energized, for allowing the rotor of the motor to rotate in one direction at one of two selectable speeds to thereby impart forward motion to the platform, and for allowing the rotor of the motor to rotate in another direction to thereby impart rearward motion to the platform; and a step ladder having a planar rectangular top step with a forward extent and a rearward extent, a pair of spaced and tubular front legs pivotally coupled to the frontal extent of the top step and extending vertically downwards therefrom, a pair of spaced and tubular back legs pivotally coupled to the rearward extent of the top shelf and extended angularly downwards therefrom, a sequence of spaced horizontal steps coupled between the rear legs, and a pair of braces with each brace having a forward end pivotally coupled to one of the front legs and a rearward end with a notch formed thereon that is removably securable to a pin affixed to the rearwardly positioned rear leg, each leg of the ladder terminated at a lower and open free end and defining a mortise, the mortise of the free ends of the front legs having the tenons of the forward pair of bracing members removably secured therein, and the mortise of the free ends of the rear legs having the tenons of the rearward pair of bracing members removably secured therein to place the step ladder in an extended orientation for use, and the legs removable from the bracing members and foldable in a juxtaposed relation to thereby place the step ladder in a retracted orientation for storage.

* * * * *